United States Patent [19]

Jeruzal

[11] Patent Number: 4,919,277

[45] Date of Patent: Apr. 24, 1990

[54] SHIPPING RACK INCLUDING DUNNAGE BAR LOCKING MECHANISM

[75] Inventor: Thomas M. Jeruzal, Brighton, Mich.

[73] Assignee: Chrysler Motors Corporation, Highland Park, Mich.

[21] Appl. No.: 325,798

[22] Filed: Mar. 20, 1989

[51] Int. Cl.[5] ..... A47G 19/08

[52] U.S. Cl. ..... 211/41; 211/162; 211/183; 206/454; 410/43; 292/167; 74/501.5 H; 294/67.33

[58] Field of Search ..... 211/183, 162, 41; 108/55.1; 206/449, 451, 454; 410/32, 34, 38, 39, 43, 41; 292/167; 74/102, 108, 501.5; 294/67.33

[56] References Cited

U.S. PATENT DOCUMENTS

| | | | |
|---|---|---|---|
| 2,675,714 | 4/1954 | Allard | 74/501.5 |
| 4,584,998 | 4/1988 | Panushka | 74/501.5 |
| 4,733,781 | 3/1988 | Gerlach | 211/41 |

*Primary Examiner*—Blair M. Johnson
*Attorney, Agent, or Firm*—Edward A. Craig

[57] ABSTRACT

The present invention relates to a shipping rack including a dunnage bar locking mechanism for removably securing a dunnage bar between the end walls of the shipping rack. The mechanism comprises a housing secured to one end wall. A piston element is mounted within the housing for reciprocal movement. The piston element is removably secured to one end of a dunnage bar. A handle is pivotally mounted to the housing. The handle has an open position to move the piston element toward the end of the dunnage bar and a closed position to move the piston element away from the end of the dunnage bar. A means interconnects the handle and the piston element for allowing relative movement between the piston element and handle when the handle is in the closed position as a consequence of the dunnage bar being impacted by an external force.

10 Claims, 2 Drawing Sheets

SHIPPING RACK INCLUDING DUNNAGE BAR LOCKING MECHANISM

RELATED APPLICATION

This application is related to my co-pending application Ser. No. 07/325,706, filed Mar. 20, 89.

BACKGROUND OF THE INVENTION

1. Field of the Invention

The present invention relates generally to a shipping rack having a dunnage bar, more particularly, to a locking mechanism for a dunnage bar on a shipping rack.

2. Description of Related Art

Racks of the type to which the present invention relates are commonly used for shipping industrial parts. An example of such a shipping rack is disclosed in U.S. Pat. No. 4,699,280, issued Oct. 13, 1987, by inventor Donald A. Hoss. Typically, a shipping rack has a bottom wall and upstanding end and side walls. Commonly, removable dunnage bars are secured between the end walls of the shipping rack to allow elements being shipped to be easily loaded and unloaded.

In the past, dunnage bars and rack contents have been damaged due to impact loads on the bars by external forces. This has occurred because the ends of the bars are fixed relative to the end walls of the shipping rack, making the dunnage bars substantially rigid with the result that they do not give upon impact.

SUMMARY OF THE INVENTION

A shipping rack is provided comprising a bottom wall having upstanding oppositely disposed end walls. Channel structure is provided on the inner face of each end wall. The channel structure extends laterally with respect to the rack. A dunnage bar is provided on each side of the shipping rack. The ends of the dunnage bars are slidably received in the channel structure.

A dunnage bar locking mechanism is provided on each end wall adjacent each end of each dunnage bar. Each locking mechanism includes a housing secured to an end wall of the rack. A piston element is mounted within the housing for reciprocal movement. The piston element is secured to the end of the adjacent dunnage bar. The piston element is hollow. Spring means are positioned within the piston element. A handle is pivotally mounted to the housing. Means are provided interconnecting the handle to the spring means.

The handle has an open position wherein the spring means is relaxed permitting easy dunnage bar sliding in the channel structure outwardly of the rack to facilitate loading and unloading of the rack. The handle has a closed position wherein the spring means is compressed causing the piston element to draw the dunnage bar inwardly of the rack against a rack load to stabilize the load. The piston element is thereafter movable in either direction under impact forces exerted on the attached dunnage bar to permit dunnage bar movement during absorption of the impact forces.

DESCRIPTION OF A PREFERRED EMBODIMENT

Figure 1:
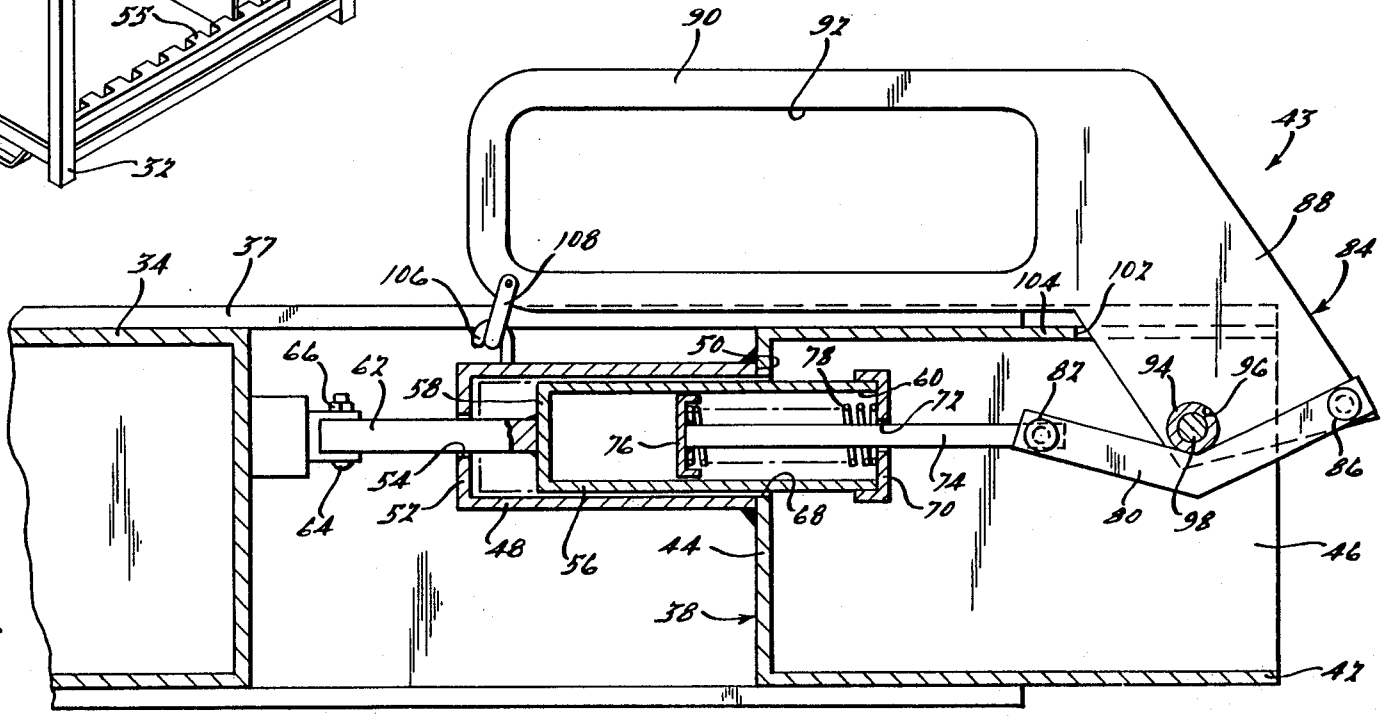
FIG. 1 is a perspective view of a shipping rack having a dunnage bar locking mechanism forming one embodiment of the present invention.

Referring to FIG. 1, it will be noted that the shipping rack 10 includes a bottom wall 12 having a width and a length width an upstanding end wall 14, 16 at each end of the length of the bottom wall 12. As will be appreciated, the bottom wall 12 provides support for materials which are loaded thereon.

The end wall 16 comprises a frame consisting of upper rail 24 and vertical end rails 26, 28. These elements may be fabricated from tubular steel and welded together. The end wall 14 also includes vertical end rails 30, 32 and an upper rail 33. Dunnage bars 34, 36 extend between vertical end rails 26, 30 and 28, 32, respectively. The dunnage bars are slidingly received in and supported by channel members 35, 37, 39, 41 and connected to dunnage bar locking mechanisms 40, 43, 45, 47. These components are secured in place by welding. A slotted parts retainer 49, 51 is secured to each dunnage bar 34, 36 on the inner face thereof. Aligned slotted parts retainers 53, 55 are secured to the bottom wall 12.

Figure 2:
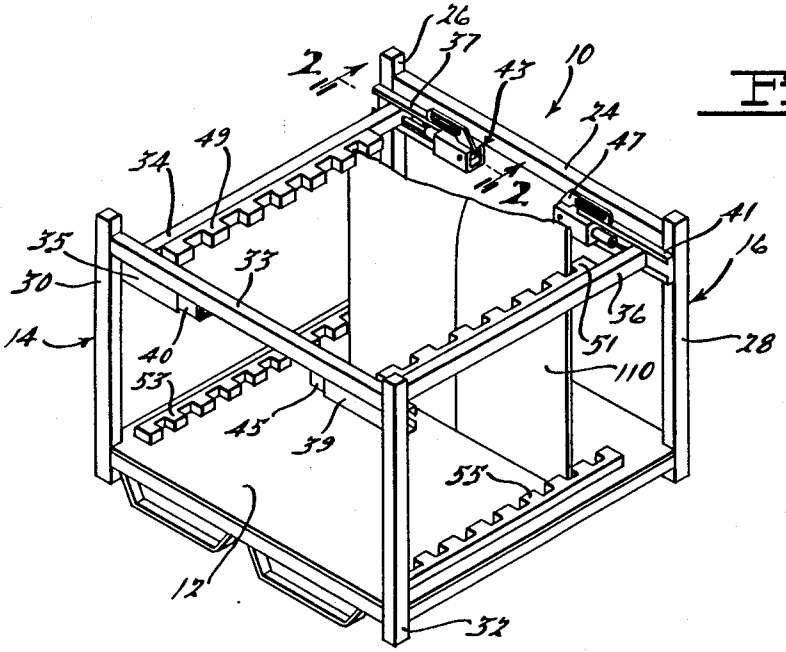
FIG. 2 is a sectional view of the dunnage bar locking mechanism of FIG. 1 taken substantially along the line 2—2 thereof looking in the direction of the arrows.
Figure 3:
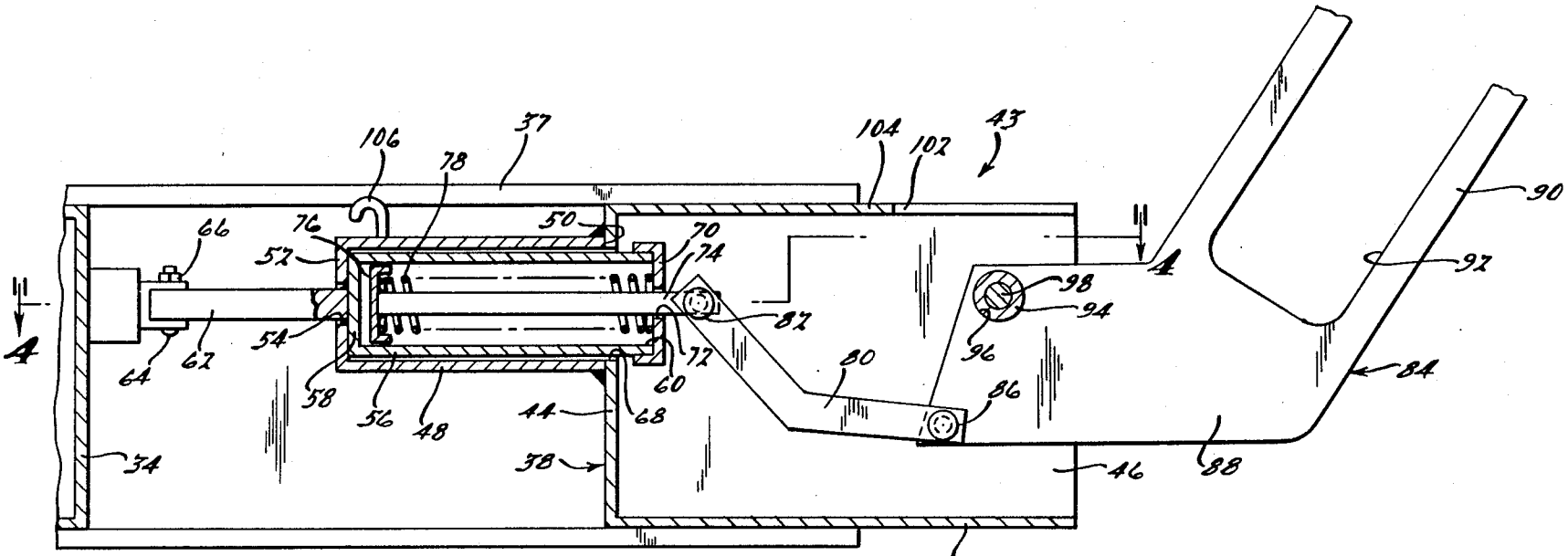
FIG. 3 is a view similar to FIG. 2 illustrating the handle in an open position.
Figure 4:
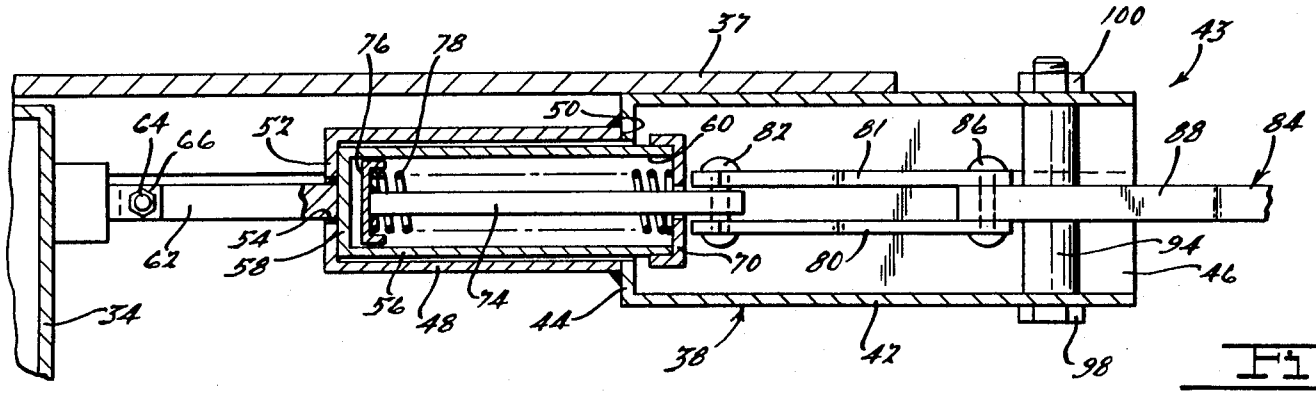
FIG. 4 is a sectional view taken substantially along the line 4—4 of FIG. 3 looking in the direction of the arrows.

As will be seen in FIGS. 2 through 4, the locking mechanisms, illustratively locking mechanism 43, include a housing 38. The housing 38 comprises a generally hollow rectangular bracket 42 having a closed end 44 and an open end 46. The housing 38 further comprises a generally circular hollow cylinder 48 welded to the closed end 44. The cylinder 48 has an open end 50 abutting the closed end 44 and a closed end 52 with a generally circular aperture 54 extending through the closed end 58 of the cylinder 48. A generally hollow cylinder or piston element 56 is mounted for reciprocal movement within the cylinder 48. The piston element 56 has a closed end 58 and an open end 60. A pin member 62 is welded to the closed end 58 of the piston element 56 and extends through the aperture 54 in the cylinder 48. The pin member 62 is removably secured by a fastening means such as a threaded fastener 64 and a nut 66 to the dunnage bar 34. The dunnage bar may be entirely removed for loading or unloading the rack 10 by disengaging the fastener.

The piston element 56 extends through an aperture 68 formed in the closed end 44 of the bracket 42. A generally circular cap member 70 having an aperture 72 extending through it is secured over the open end 60 of the piston element 56 by welding or press-fitting.

A plunger 74 in the shape of a circular rod has an annular cup-shaped head 76 secured by welding to an end of the plunger 74. The head 76 is disposed within the piston element 56. The other end of the plunger 74 extends through the aperture 72 in the cap member 70. A coil spring 78 is disposed about the plunger 74 and extends between the cap member 70 and the head 76 of the plunger 74 to constantly urge the cap member 70 of the piston element 56 away from the head 76 of the plunger 74.

The other end of the plunger 74 is pivotally secured between a pair of generally angle shaped links 80, 81 by a fastening means such as a rivet 82 passing through corresponding apertures (not shown) formed in one end of the plunger 74 and links 80, 81. The other ends of the links 80, 81 are pivotally secured to a locking handle 84 by fastening means such as a rivet 86 passing through corresponding apertures (not shown) formed in one end of the locking handle 84 and links 80, 81.

The locking handle 84 is generally angularly shaped to form a first portion 88 and a second portion 90. The first portion 88 and a second portion 90 are inclined relative to each other. The second portion 90 includes a generally rectangular opening 92 which is adapted to be grasped by an operator. The first portion 88 includes a bushing 94 disposed between the side walls of the bracket 42 which passes through an aperture 96 formed in the locking handle 84. A fastener 98 passes through apertures (not shown) in the side walls of the bracket 42 and through the bushing 94. A nut 100 is threadably engaged at one end of the fastener 98.

As noted in FIG. 2, the bracket 42 has a slot 102 formed in the upper or top wall 104. The slot 102 allows the locking handle 84 to be rotated past an overcenter position of a vertical axis passing through the fastener 98 to a closed position in which the second portion 90 is substantially parallel to the bracket 42. When this happens, the head 76 of the plunger 74 acts against the spring 78 to move the piston element 48 and dunnage bar 38 toward the locking handle 84. This movement is reversed when moving the locking handle 84 to an open position a noted in FIG. 3.

Additionally, the second portion 90 of the locking handle 84 may be removably secured to the housing 41 by an inverted hook 106 welded to the cylinder 48 and a ring member 108 pivotally secured to one end of the second portion 90. It should be appreciated that any suitable means may be used to removably secure the second portion 90 of the locking handle 84 to the housing 38.

In operation, when an external force is applied to the dunnage bar 34, the cap member 70 of the piston element 56 acts against the spring 78 which cushions the relative movement of the piston element 56 away from the locking handle 84 when the locking handle 84 is in the closed overcenter position. When the external force is absorbed, the compressed spring 78 acts against the head 76 of the plunger 74 to move the cap member 70 and piston element 56 toward the locking handle 84. The piston element 56 slides on the plunger 74. Thus, it may move to the right as viewed in FIG. 2 with the spring 78 being extended or it may be moved to the left as viewed in FIG. 2 with the spring 78 being compressed. This permits the same movement of the dunnage bar 34.

Operation of the invention may best be understood by reference to FIG. 1. A car hood 110 is representatively shown as being loaded in the rack 10 (it being understood that the rack 10 would normally be fully loaded, one hood only being shown for the purpose of clarity). The hood 110 extends between opposed slots of the upper dunnage bar part retainers 49, 51 and lower part retainers 53, 55. The locking handles 84 of the locking mechanisms 40, 43, 45, 47 are shown in the closed position. This results in the dunnage bars 34, 36 being drawn inwardly of the rack 10 via the channel members 35, 37, 39, 41 to place the part retainers 49, 41 in engagement with the hood 110 to thereby stabilize the load.

The lower edges of the hood 110 fit loosely in the slots of the lower part retainers 53, 55. The lower portion of the hood 110 is thus capable of limited lateral or sideward movement with respect to the rack 10.

If, for example, the dunnage bar 36 is impacted externally of the rack 10, it can slide in the channel members 39, 41 inwardly of the rack 10, with the springs 78 of the locking mechanisms 45, 47 being extended and the piston elements 56 sliding on the plungers 74. These dynamics result in pressure being applied to the adjacent edge of the hood 110. This pressure is transmitted through the hood 110 to the other dunnage bar 34. The dunnage bar 34 consequently exerts a pull on the pin members 62 of locking mechanisms 40, 43 causing the springs 78 thereof to compress and the piston elements 56 to slide on the plungers 74. The dunnage bar 34 will slide in the channel elements 35, 37 outwardly of the rack 10.

It will be appreciated that the above described activity takes place substantially instantaneously upon the dunnage bar 36 being impacted. The total movement of the various elements need not be extensive. An inch or less is generally adequate inasmuch as the force of the impact is absorbed by the springs 78. The net result is that both the load and the dunnage bars are protected from damage. After impact, the various elements return to their original positions through the action of the springs 78. Should dunnage bar 34 be impacted, the reverse action would occur.

I claim:

1. A shipping rack comprising a bottom wall having upstanding oppositely disposed end walls and sides, channel structure provided on an inner face of each end wall, the channel structure extending laterally with respect to the rack, a dunnage bar on each side of the shipping rack, the ends of the dunnage bars being slidably received in a respective channel structure, a dunnage bar locking mechanism on each end wall adjacent each end of each dunnage bar, each locking mechanism including a housing secured to an end wall of the rack, a piston element mounted within the housing for reciprocal movement, the piston element being secured to the end of the adjacent dunnage bar, the piston element being hollow, spring means positioned within the piston element, a handle pivotally mounted to the housing, means interconnecting the handle to the spring means, the handle having an open position wherein the spring means is relaxed permitting easy dunnage bar sliding in the channel structure outwardly of the rack to facilitate loading and unloading of the rack and a closed position wherein the spring means is compressed causing the piston element to draw the dunnage bar inwardly of the rack against a rack load to stabilize the load, the piston element being thereafter movable in either direction under impact forces exerted on the attached dunnage bar to permit dunnage bar movement during absorption of the impact forces.

2. A shipping rack as defined in claim 1, further characterized in that the piston element has a closed end and an open end, and a cap member disposed about the open end of the piston element.

3. A shipping rack as defined in claim 2, further characterized in that the means interconnecting the handle to the spring means comprises a plunger having a head portion at one end disposed within the piston element forwardly of the spring means and the other end extending through an aperture formed in one end of the cap member and connected to the handle.

4. A shipping rack as defined in claim 3, further characterized in that the spring means comprises a coil spring disposed about the plunger between the head portion and the cap member.

5. A shipping rack as defined in claim 4, further characterized in that at least one link is pivotally connected between one end of the plunger and the handle.

6. A shipping rack as defined in claim 5, further characterized in that the housing comprises a bracket having a hollow rectangular shape with a closed end and an open end, and a hollow cylinder secured to the closed end of the bracket.

7. A shipping rack as defined in claim 6, further characterized in that the closed end of the bracket includes an aperture formed therein and aligned with the cylinder such that the piston element is disposed in the cylinder and extends through the aperture in the closed end of the bracket.

8. A shipping rack as defined in claim 7, further characterized in that a fastener extends through an aperture formed in each side wall of the bracket, a nut threadably engages one end of the fastener, and a bushing is disposed about the fastener between the side walls of the bracket and extends through an aperture formed in the handle.

9. A shipping rack as defined in claim 8, further characterized in that the handle has a first portion and a second portion, the first portion and second portion being inclined relative to each other.

10. A shipping rack as defined in claim 9, further characterized in that the bracket includes a slot formed in the upper wall of the bracket to allow the second portion of the handle to be substantially parallel to the upper wall of the bracket when the handle is in the closed position.

* * * * *